United States Patent [19]

Arai et al.

[11] 4,089,507

[45] May 16, 1978

[54] METHOD AND APPARATUS FOR MAINTAINING UNIFORMITY OF MIXED DUST SLURRY STORED IN A BASIN

[75] Inventors: Izumi Arai, Chigasaki; Yasuteru Yamada; Akio Mutsuta, both of Wakayama; Hirotoshi Hirano, Isehara; Yasuzou Tuchida, Osaka, all of Japan

[73] Assignees: Sumitomo Heavy Industries, Ltd., Tokyo; Sumitomo Metal Industries, Ltd., Osaka, both of Japan

[21] Appl. No.: 667,028

[22] Filed: Mar. 15, 1976

[51] Int. Cl.[2] ..... B01F 7/16; B01F 15/00

[52] U.S. Cl. ..... 366/102; 55/285; 366/160; 366/172

[58] Field of Search ..... 259/8, 9, 148, 149, 259/151, 154; 302/52, 53, 56, 57; 55/285, 286

[56] References Cited

U.S. PATENT DOCUMENTS

| | | | |
|---|---|---|---|
| 3,309,148 | 3/1967 | Wilder | 302/53 |
| 3,479,016 | 11/1969 | Woock | 259/149 |
| 3,502,305 | 3/1970 | Grün | 259/8 |
| 3,564,570 | 2/1971 | Lincoln et al. | 55/286 |

*Primary Examiner*—Leonard D. Christian
*Attorney, Agent, or Firm*—Kurt Kelman

[57] ABSTRACT

A method and apparatus is disclosed for maintaining the uniformity of a mixed dust slurry stored in a basin, the mixture comprising blast furnace dust slurry, steel furnace dust slurry (defined in the specification) and, if necessary, dry dust or filtrated cake and having a relatively high concentration — 32% by weight or more — of solids. The mixture in the storage basin is stirred or agitated by injecting gas or the liquid to be used in the mixture itself into the basin. The method and apparatus are utilized as a part of a system for manufacturing reduced pellets from the dust discharged in an iron foundry or steel mill.

3 Claims, 9 Drawing Figures

METHOD AND APPARATUS FOR MAINTAINING UNIFORMITY OF MIXED DUST SLURRY STORED IN A BASIN

FIELD OF INVENTION

The present invention relates to a method and apparatus for storing a slurry of dust in a system for manufacturing reduced pellets from dust discharged from furnaces in an iron industry and, more particularly to an apparatus and method for maintaining uniformity of the dust slurry stored in a basin or basins for facilitating operation of the pellet manufacturing system which is adapted to recover resources, i.e., ferrous material to be used as part of pellets.

BACKGROUND OF INVENTION

In the iron industry, as in other industries making efforts these days for preventing pollution, the dust generated by blast furnaces and steel producing furnaces (e.g. converters, open-hearth furnaces such as those producing steel from pig iron and/or scrap iron: hereinafter referred to as "steel furnace") has been collected so it will not be diffused or scattered, in order to eliminate the pollution problem. Various dust collecting means such as electric precipitators, venturi-scrubbers, bag filters or the like have been used in association with the respective furnaces. However, the enormous amount of dust thus collected may likely cause secondary pollution problems depending on the manner of disposal or dumping.

Also it has been pointed out that the dust thus collected contains a relatively high proportion of ferrous material and therefore the dumping of the dust is a waste of reusable resources.

Accordingly it has also been proposed to manufacture reduced pellets from the dust by granulating the same. One of the ways for producing such pellets is to mix and knead blast furnace dust and steel furnace dust wherein the latter serves as binding agent to produce very dense material of high strength.

However, in this prior art method, it is necessary to mix the blast furnace dust and steel furnace dust uniformly before adding water (about 10% by weight) to proceed kneading. However, it is difficult to mix these two kinds of dust uniformly. Also, such mixing requires a large mixing apparatus or an air blender and the secondary dust generated by use of these mixing apparatuses creates another pollution problem.

In a steel mill, or a iron foundry, dust is generated by, for example, blast furnaces, open-hearth furnaces, converters, yard thickeners, classifiers, sintering apparatuses, monitors in the factory buildings, dust collecting apparatuses and so on and the physical and chemical properties of the dust vary from place to place depending on where it is generated. Therefore, if it is desired to process all the dust generated in the iron foundry into reduced pellets, it is essential to mix the dust uniformly and this has heretofore been quite difficult.

Also, there are dust collectors of wet type which discharge the dust in a slurry state. The treatment of such slurry becomes a problem, particularly in the case of blast furnace dust and the concentration thereof is low, since blast furnace dust contains many coarse particles and, thus, the sedimentation rate of the blast furnace dust in a basin is high and compressing and packing or condensing effect in the lower part of the basin may make it difficult to transport the dust to the next stage through conduit means.

As a whole, it has been found that, in order to uniformly mix the dust discharged from several places in the iron foundry, it is necessary to control the feeding or supplying condition of several kinds of dust. In other words, in order to produce reduced pellets of high quality, it is necessary to feed mixed dust while maintaining its chemical and physical composition and properties constant; otherwise a product of high quality may not be obtained.

SUMMARY OF INVENTION

Accordingly, it is an object of the present invention to provide a method and apparatus for storing a mixed slurry mainly comprising blast furnace dust and steel furnace dust in a basin or basins without creation of a pollution problem.

It is still another object of the present invention to provide a method and apparatus for storing the mixed slurry so as to be able to feed or supply the mixed slurry having desired uniformity to the next operating stage in the pelletizing system.

It is a further object to store the slurry in a basin or basins in a uniformly mixed state.

It is also an object of the present invention to provide a method and apparatus as above which does not require large power consumption.

The objects above are achieved according to the present invention, wherein the recovered dust from the blast furnaces and the steel furnaces is stored in slurry state in a basin or basins where it is agitated and mixed properly by injecting gas thereinto or supplying the mixed slurry in jet. Also the concentration range of the mixed slurry is maintained over a certain value or adjusted by adding dry dust or filtrated cake, say over 32% concentration by weight.

The present invention will be further clarified by referring to the accompanying drawings which are briefly explained below.

BRIEF EXPLANATION OF DRAWINGS

Reference is made to the accompanying drawings wherein.

DETAILED DESCRIPTION OF PREFERRED EMBODIMENTS

It is known that there are differences in physical properties as well as in chemical composition between blast furnace dust and steel furnace dust. As an example, such differences are shown in Tables I and II below.

Table I

| | True Specific Gravity | Dust Particle Dia. (mm) >0.295 | 0.295 – 0.147 | 0.147 – 0.074 | 0.074 – 0.064 | <0.064 |
|---|---|---|---|---|---|---|
| Blast Furance Dust | 2.5 | 0.3 | 4.2 | 17.2 | 13.4 | 64.9 |
| Steel Furance Dust | 5.0 | 0.3 | 1.5 | 2.6 | 2.5 | 93.2 |

Note:
1. True Specific Gravity was measured by Pycnometer.
2. Particle Dia. was measured by Wet Sieve Process and the Values are indicated in %.

Table II

| | (Composition %) C | $SiO_2$ | $Fe_2O_3$ | FeO | $Al_2O_3$ | Others |
|---|---|---|---|---|---|---|
| Blast Furnace Dust Slurry | 46.5 | 6.5 | 34.5 | 0.6 | 3.3 | 8.6 |
| Steel Furnace Dust Slurry | 0.4 | 1.7 | 26.0 | 60.5 | <0.01 | 11.3 |

Figure 1:
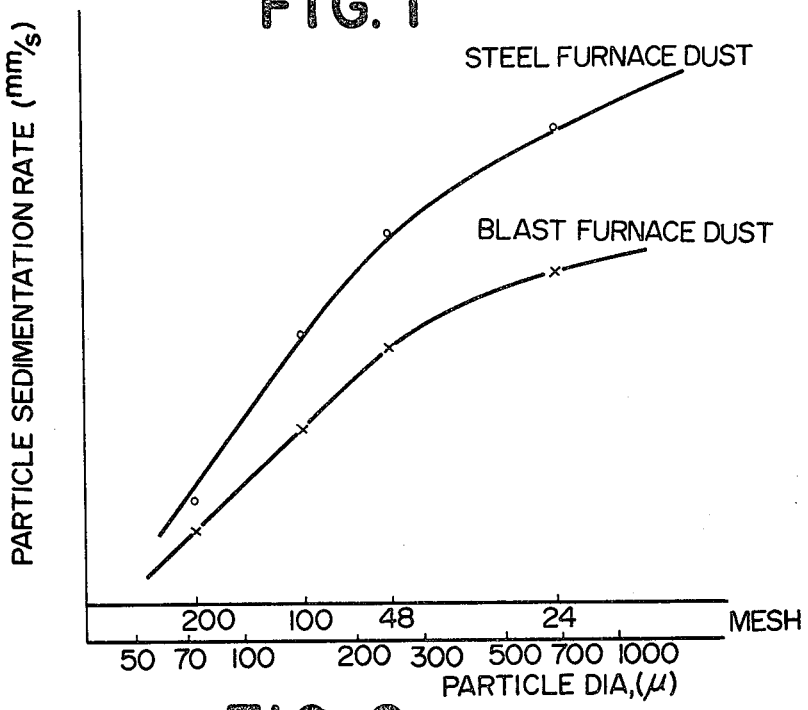
FIG. 1 shows data representing the respective sedimentation rates of dust particles in the slurry discharged from blast furnaces and steel furnaces.

Also, the sedimentation rate of blast furnace dust differs from that of steel furnace dust. This difference is illustrated in FIG. 1 wherein it is apparent that the steel furnace dust settles faster than the blast furnace dust as far as the diameters of both classes of dust particles are the same. However, as noted in Table I above, the steel furnace dust contains a larger proportion of fine particles than does the blast furnace dust, and, therefore, actual sedimentation velocity of the steel furnace dust as a whole is far lower than that of the blast furnace dust as a whole.

If the steel furnace dust consisting of fine particles exists within the mixed dust slurry, sedimentation of the coarse blast furnace dust particles tends to become slower due to the interference with the fine particles slowly settling.

Therefore, it is possible to prevent rapid sedimentation and packing or condensation of the blast furnace dust by utilizing such interference if the steel furnace dust is added to the blast furnace dust and mixing is performed in a slurry state. Also, it is preferable to provide a nozzle means in a basin having a stirring means in which the mixed slurry is supplied, the nozzle means being arranged for blowing fluid either gas or liquid into the basin so as to maintain the uniformity of the mixed slurry stored in the basin.

Air usually or sometimes "nitrogen" is employed if the fluid is gas and the feed of mixed slurry is employed if it is liquid. For the purpose of convenience, hereinafter throughout the specification and claims, the former will be referred to as "air stirring" or "gas stirring" and the latter as "self-liquid stirring".

Several tests were conducted by the air stirring process by varying the concentration of mixed slurry consisting of blast furnace dust and steel furnace dust, the mixing ratio of the former to the latter being within the range of 1 to 3 ~ 2 to 3. According to the tests, it has been found that the blast furnace dust settles relatively fast when the concentration of the mixed slurry is low so that uniform and enough diffusion of the dust may not be obtained.

It has also been noted that, if the steel furnace dust thickened in a thickener is to be transferred to a stirring basin through a feed conduit, the steel furnace dust slurry can not be transferred if its average concentration exceeds approximately 30% by weight because it tends to easily become muddy due to its physical properties. There is also a limiting factor with respect to the high concentration of blast furnace slurry due to the coarse dust particles contained therein. It is not impossible to transfer and/or handle the blast furnace dust slurry having its concentration of over 30% by weight by using a conventional slurry pump system and thickening device, but the coarse particles contained in such high concentration may sometimes create problems or damage in the pump system and thickening device. In other words, it may be said that a mixed slurry having a concentration of over 30% may be obtained by simply mixing the unfiltrated blast furnace slurry and the unfiltrated steel furnace slurry; however, such a process may, sometimes, cause problems in the pump system and thickening device which result in interruption of the operation of the whole system. Therefore, in case such drawbacks seem likely to occur, some countermeasures to avoid them might be preferable.

Also, in order to maintain the uniformity of a mixed slurry, it is preferable to have the mixed slurry with a higher concentration. Also this may serve to increase the efficiency of the pelletizing system. To such end, the inventors conceived the idea of introducing dry dust into the mixed slurry in case the concentration of the mixed dust slurry (comprising of blast furnace dust slurry and steel furnace dust slurry) does not exceed 32% by weight, the dry dust being collected by collectors of dry type such as bag filters, cyclone catchers, or the like which collect dust from the plant buildings, the top of the furnace and so on. Also, filtrated cake may be employed in place of the dry dust.

Some physical properties and chemical compositions of the dry dust to be employed are shown in the following Tables III and IV, respectively.

Table III

| Dust | True Specific Gravity | (Dust Properties) Dust Particle Dia. (mm) >0.295 | 0.295 – 0.147 | 0.147 – 0.074 | 0.074 – 0.044 | <0.044 |
|---|---|---|---|---|---|---|
| Blast Furnace (Top and Front of Furnace) | 3.40 | 1.2 | 20.9 | 52.8 | 19.3 | 5.8 |
| Converter Electric Precipitator | 4.42 | 0.1 | 0.2 | 0.4 | 1.3 | 98.0 |
| Sintering Electric Precipitator | 3.82 | 0.7 | 13.7 | 39.5 | 18.9 | 27.8 |

Note: Note for Table I is applicable to this Table III.

Table IV

| | (Dust Composition %) C | $SiO_2$ | $Fe_2O_3$ | FeO | $Al_2O_3$ | Others |
|---|---|---|---|---|---|---|
| Blast Furnace Dust Slurry | 46.5 | 6.5 | 34.5 | 0.6 | 3.3 | 8.6 |
| Converter Dust Slurry | 0.4 | 1.7 | 26.0 | 60.5 | <0.01 | 11.3 |
| Blast Furnace Dust (Top and Front) | 29.35 | 6.59 | 39.59 | 2.62 | 2.53 | 19.32 |
| Converter Electric | 0.27 | 1.11 | 88.79 | 0.83 | 0.45 | 8.55 |

Table IV-continued

| | (Dust Composition %) | | | | | |
|---|---|---|---|---|---|---|
| | C | $SiO_2$ | $Fe_2O_3$ | FeO | $Al_2O_3$ | Others |
| Precipitator Dust | | | | | | |
| Sintering Electric Precipitator Dust | 3.58 | 7.36 | 63.04 | 4.77 | 2.44 | 18.81 |

Figure 2:
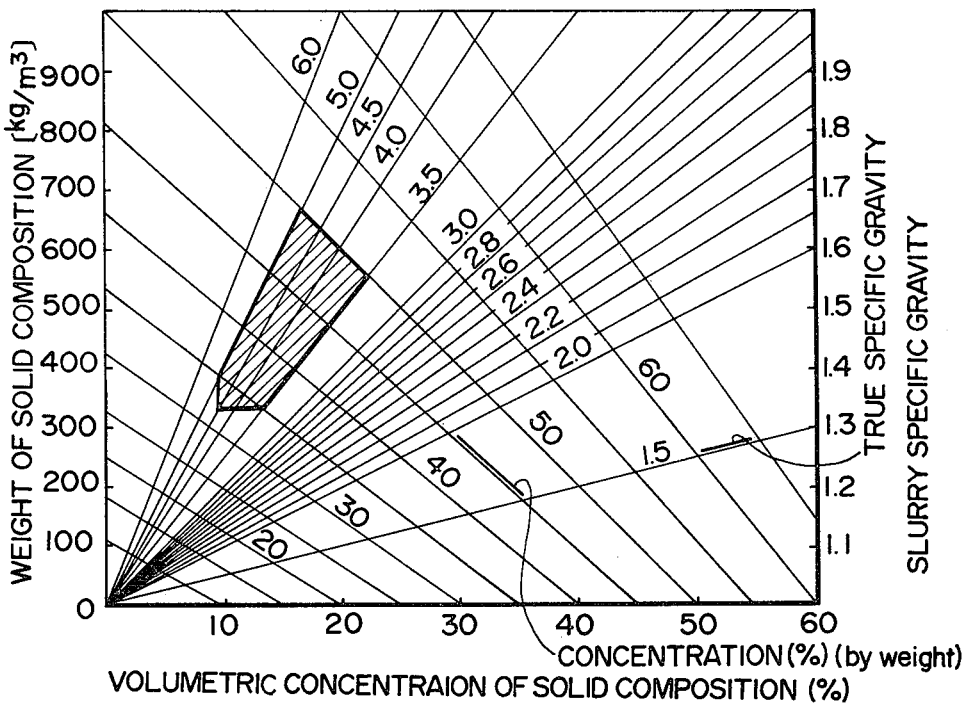
FIG. 2 is a graph showing a preferable operation range of the mixed slurry (with dry dust added) for air stirring with respect to the concentration of the slurry and other factors involved.

The conception of incorporating dry dust in the mixed slurry (consisting of blast furnace dust slurry and steel furnace dust slurry in the ratio of 1 to 3 ~ 2 to 3) was examined and tested under the air stirring system and the result is illustrated in FIG. 2. In this FIG. 2, the shaded area is the operable range for mixing by the air stirring process. It is to be noted with respect to FIG. 2 that the upper limit of the concentration by weight is the highest one at which air stirring was confirmed to be possible, but it does not mean that air stirring is impossible over the upper border illustrated. According to the graph in FIG. 2, it may be said that with the air stirring process it becomes hard to uniformly distribute dust particles in the slurry when the concentration of the slurry becomes lower than 32% by weight.

Accordingly, it is indispensable to maintain the concentration of the whole slurry over 32% by weight in order to obtain uniformly diffused dust slurry. If necessarry, this is achieved by adding dry dust to the mixture of blast furnace dust slurry and steel furnace dust slurry. Of course, as already mentioned, it is possible to use filtrated cake produced from dust slurry in place of dry dust. In addition to increasing the concentration of the mixed slurry by adding dry dust or filtrated cake as above, it is possible to add fine coke so as to increase the ratio of coke in the final pellets if desired.

Now the air stirring system will be explained referring to FIG. 3.

Into a mixing tank 10 having a rotatable agitator 11, furnace dust slurry and steel furnace dust slurry are fed through respective transfer means such as conduits 12 and 13, respectively wherein they are admixed with each other. The concentration of each slurry is approximately the same — usually around 30% by weight as explained before. In order to maintain the concentration of the mixture over 32%, an appropriate amount of the selected dry dust is charged into the tank 10 through feeding means such as a conveyor 14 if it is necessary to do so. It is preferable to provide a control means for regulating the mixing ratio and the concentration of the dust supplied through the conduits 12 and 13 and the conveyor 14. To such end, means (not shown) for detecting the feed rate and amount of dust slurry or dry dust (or filtrated cake) is appropriately disposed in each of transferring conduits 12 and 13 and in the conveyor 14 and the mixing ratio and the concentration of the mixture may be controlled to achieve the desired state, i.e. optimum mixing ratio and concentration, based on the values detected by the respective detecting means.

In order to store the uniformly mixed slurry produced in the mixing tank 10, there is provided a basin 15 of air-stirring type as a stage subsequent to the mixing tank 10. Further details of the basin 15 which represents some of the features of the present invention will be explained hereunder referring to FIG. 4.

Figure 3:
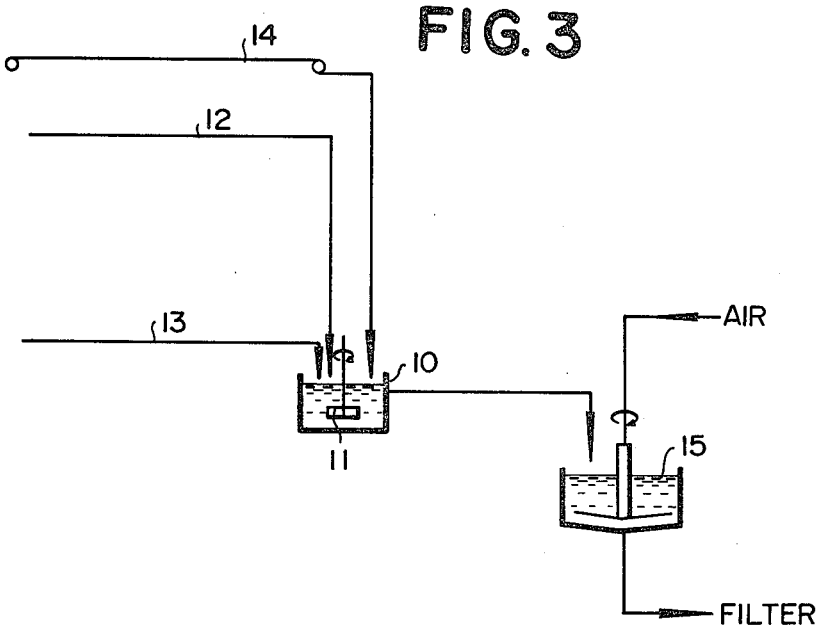
FIG. 3 is a schematic illustration of the air-stirring system.
Figure 4:
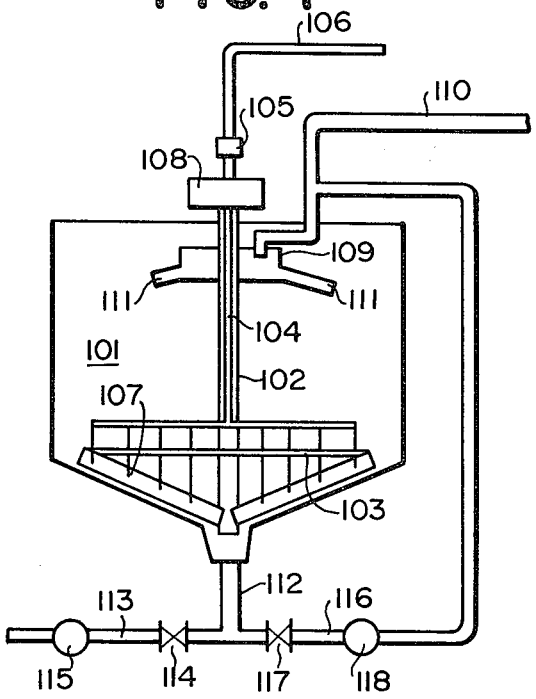
FIG. 4 is an embodiment of a storage basin of air-stirring type.

In FIG. 4, there is shown a schematic illustration of a air-stirring basin corresponding to the basin 15 in FIG. 3 and its associated auxiliary means or the like. A basin body 101 is arranged to store and reserve mixed slurry from the mixing tank 10 shown in FIG. 3. In the body 101, a hollow shaft 102 is rotatably mounted and at the lower end of the shaft, a rake 103 is fixed to the shaft 102 so as to be rotated with the shaft. An air passage 104 extending through the hollow shaft 102 is adapted to pass the air from a stationary air feed conduit 106 into the basin body 101 through a rotary joint 105. In the rake 103, there is disposed a plurality of air nozzles 107 opening toward the closely adjacent bottom wall of the basin body and communicating with the air passage 104. A driving device 108 is disposed at the upper portion of the shaft 102 so as to rotate the shaft 102 together with the rake 103. At the upper portion of the basin body 101, a receptacle 109 is affixed to the shaft 102 and adapted to receive the mixed dust slurry through a feed conduit 110 communicating with the mixing tank 10. The upper portion of the receptacle 109 opens upwardly so as to admit the end of the feed conduit 110 so that feed of mixed slurry may be received in the receptacle 109 even during the rotation of the shaft 102 which accompanies the affixed receptacle 109 to unitarily rotate therewith. Around the lower circumferential periphery of the receptacle 109, there are provided a plurality of troughs 111 radially and outwardly extending from the receptacle so that the mixed slurry received in the receptacle 109 is distributed in the basin body 101 through the troughs 111. The radial length of each of the respective troughs 111 is preferably different so that uniform distribution of the mixed slurry within the basin body 101 is enhanced.

At the lower portion of the basin body 101, a conduit 112 is connected for discharging the mixed slurry. The discharge conduit 112 branches into a conduit 113 adapted to feed the mixed slurry to a filter or the like in the pelletizing system and another conduit 114 adapted to recycle the mixed slurry back to the basin body 101. As shown, in the feed conduit, a valve 114 and a slurry pump 115 are disposed and, through the pump 115, the mixed slurry is conveyed from the basin body 101 to the next stage of the pelletizing system such as the filter (not shown) mentioned above. On the other hand the conduit 116 opens to the conduit 110 for recycling the mixed slurry through the valve 117 and the recycle pump 118.

By the arrangement explained above, the mixed slurry within the basin body 101 is continuously subjected to the influence of air bubbles blown out from the nozzles 107 and tending to move upwardly so that the settling of the dust in the slurry is effectively prevented or inhibited. If the coarse dust settles in the lower part of the basin body 101, it may be recycled through the conduit 116 to the feed conduit 110 so that the coarse dust also may be uniformly diffused within the mixed slurry and the uniformity of the mixed slurry stored in the basin is assured. The uniformity of the mixed slurry thus maintained, of course, contributes to the production of dust pellets of uniform quality.

Although the basin was explained with respect to the air stirring system and a single basin type, it is customary to employ at least two basins within a pelletizing system so that mixed slurry may be supplied to the next stage in the pelletizing system without interruption in the feeding of the mixed slurry.

Figure 5:
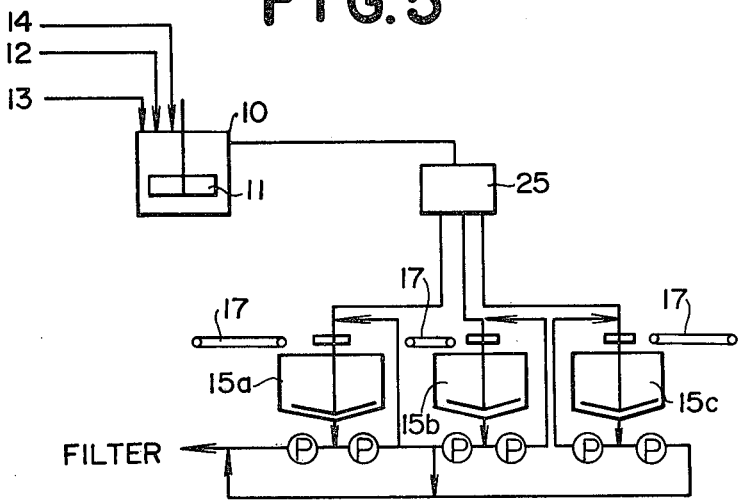
FIG. 5 is a schematic illustration of arrangement for a plurality of basins.

A pelletizing system in which a plurality of basins is employed is schematically illustrated in FIG. 5 wherein the same reference numerals employed in FIG. 3 are employed to designate the same elements in FIG. 3. In addition to the above, in FIG. 5, three basins 15*a*, 15*b* and 15*c* are illustrated and, between these basins and the mixing tank 10, a distributor 25 is disposed so as to feed the mixed slurry into any one of the plurality of basins 15*a*, 15*b* and 15*c* by switching a change-over valve (not shown) in the distributor 25. In this illustration, a plurality of pumps "P" are disposed in the outlet lines of the respective basins so as to feed the mixed slurry to a filter or to recirculate the slurry back into the basin. At each of the upper portions of the basins, an additional conduit 17 is illustrated and this conduit is used to selectively or appropriately add coke or the like to the mixed slurry.

The schematic arrangement of FIG. 5 is, of course, applicable to "gas-stirring" and "self-liquid stirring".

As to the arrangement illustrated in FIG. 5, the normal operation may be performed as exemplified in that one of the basins 15*a*, 15*b* and 15*c* is in the process for introducing the mixed slurry from the distributor 25 while one of the remaining two is in the process for feeding the slurry to the next stage in the system, e.g. a filter, and the last one is storing the mixed slurry with continuing stirring or agitation. Therefore, one of the three is always in the condition of storing the mixed slurry and, into this basin, materials may be added for regulating the mixing ratio or concentration of the mixed slurry in the basin body.

In FIG. 5, three basins are illustrated; however, two basins also may be employed. In the case of two basins, the operation may be performed in such a way that, in one of the basins, the slurry is being received for 24 hours and thence filtration of the slurry is proceeded for 24 hours by supplying the slurry therefrom. In the other, the operation is performed vice-versa. Therefore the process will be repeated by a batch system every 48 hours. Also, in case two basins are used for receiving slurry, the concentration of the slurry, the proportion of carbon or the like, etc. are preferably monitored and an appropriate adjustment such as adding fine coke through the conduit 17 may be considered. Also, in the stage of filtrating or receiving slurry, if the concentration of the slurry in the basin body is not appropriate, the slurry may be recirculated as required.

During the course of development, the inventors have found that, when the mixed slurry contains dust discharged from a converter, especially that of gas recovery type, and has been stored in a basin of air stirring type, decrease of filtration rate of the filter employed in the pelletizing system is relatively high. The cause of this decrease in rate was sought and it was assumed that the surface of respective particles constituting the slurry is subjected to "oxidation" and/or "hydration" and the filtration property of the particles was caused to change.

Thus, the inventors did further research and development to reduce such problem in a filter and introduced the use of "nitrogen" instead of "air" or "self-liquid stirring" system which was already touched upon and will be explained later.

Before explaining "self-liquid stirring" in detail, the following is presented regarding the change in capacity of the filter with respect to the variety of slurries treated.

Table V

| | Dust Slurry | Filter Capacity Decrease (%) (Air Agitation) |
|---|---|---|
| a | Blast Furnace | Not Appreciable |
| b | Converter of Gas Recovery Type | 31.1 |
| c | Converter of Non-Gas Recovery Type | 14.9 |
| d | Mixed Slurry (a + b) | 56.6 |
| e | Mixed Slurry (a + c) | 16.1 |

Note:
Capacity Decrease was calculated by comparing filtration rate at the start of operation and after operation of 22 hours. The measurement was made as to amount of filtrated cake processed by belt filter relative to unit area thereof per hour.

As seen from the Table above, it is clear that filtration of mixed slurry containing dust discharged from a converter of gas recovery type is relatively difficult compared to the others if the air-stirring process is employed.

In order to reduce such difficulty, the inventors employed Nitrogen gas ($N_2$) in lieu of air in the process explained hereinabove and treated the mixed slurry "*d*" in Table V and found that the decreasing rate came down to 27.5% or about half that shown in Table V.

Also, the "self-liquid stirring" process was tried for the mixed slurry "*d*" and the result was also satisfactory. However, it should be noted that "self-liquid stirring" is applicable not only to the mixed slurry containing the dust discharged from a converter of gas recovery type but also to any dust slurry other than "*d*" in the Table V above.

Now "self-liquid stirring" will be explained referring first to FIGS. 6 and 7. In these drawings, a storage basin of self-liquid stirring type is illustrated. The basin comprises a basin body 201 within which a center shaft 202 is rotatably mounted. The shaft 202 is adapted to be driven by a suitable driving means such as a motor 23. At the lower part of the shaft 202, a rake 204 is mounted so as to be rotated with the shaft 202. Also, at the upper portion of the shaft 202 and within region of the body 201, a receptacle 205 is mounted to receive the mixed slurry from the distributor 25 such as shown in FIG. 5 through a feed conduit 206. The mixed slurry received in the receptacle is thence directed to troughs 207 communicating with the receptacle 205. At each radial end of the troughs 207, a plurality of pipes 208 are attached to receive the mixed slurry therein. The opposite end of each of the pipes 208 is attached to the rake by an appropriate means such as bolts or the like at the appropriate portions thereon so that the open end of the pipe 208 serving as a jet nozzle 209 faces in the direction opposite to the rotating direction (indicated by an arrow in FIG. 6) of the rake 204. The nozzles 209 are arranged closely adjacent the bottom wall of the basin body 210 to achieve optimum agitation or stirring effect in order to maintain the uniformity of the slurry within the basin body 201. At the bottom of the body 201, a discharge cone 210 is disposed in communication with a discharge conduit 211. The discharge conduit 211 is branched into two, namely a conduit 212 and a conduit 213, the former being adapted to feed the mixed slurry to the next stage in the pelletizing system such as a filter through a slurry pump 214 and the latter being in communication with the feed conduit 206 through a recycle pump 215 which is adapted to recirculate the slurry into the basin body 201. In the conduits 212 and 213, suitable valves 216 and 217 are disposed respectively so that feeding or recirculating may be optionally controlled.

Figure 6:
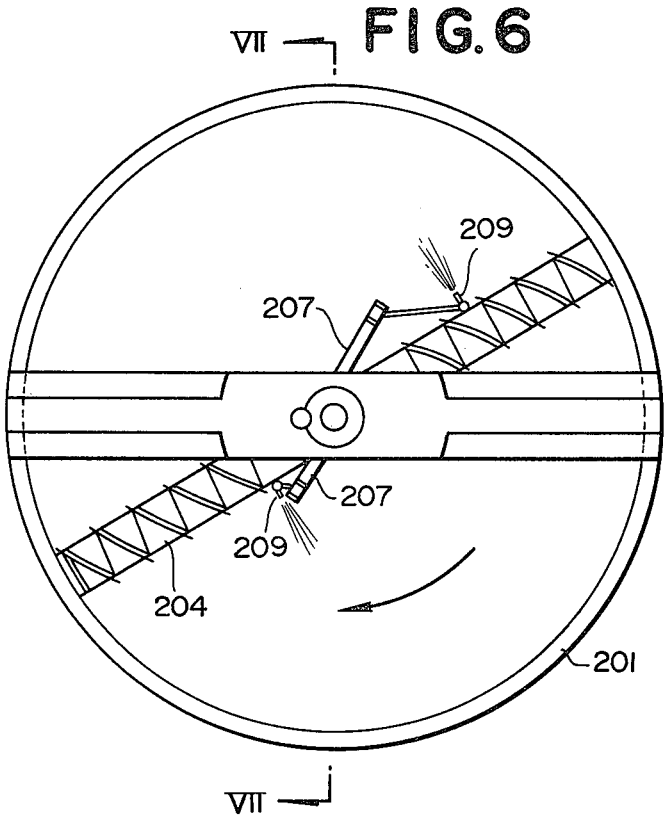
FIG. 6 is a top view of a self-liquid stirring basin.
Figure 7:
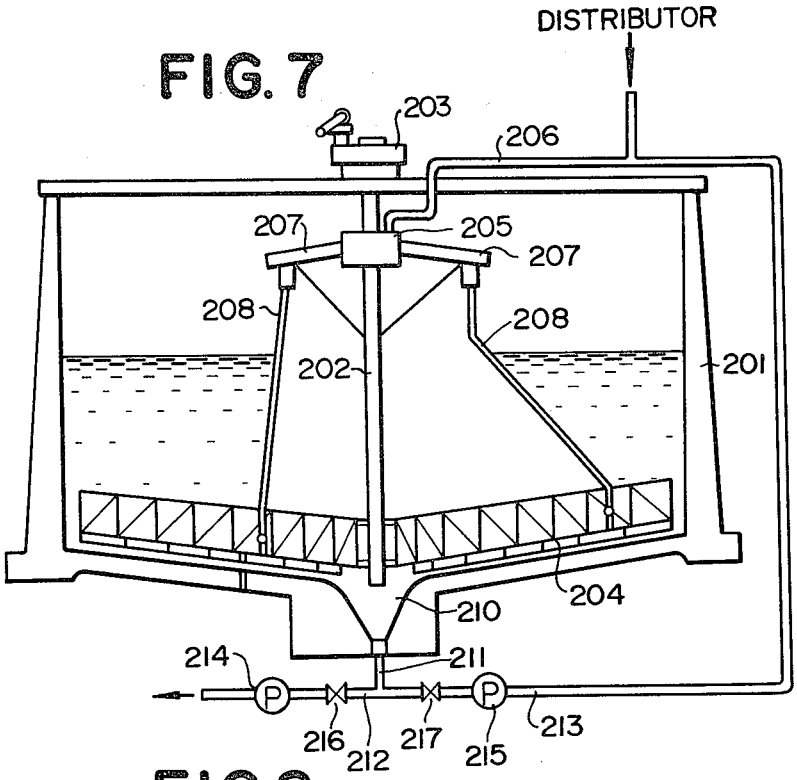
FIG. 7 is a sectional view of a self-liquid stirring basin taken along the line VII — VII in FIG. 6.

Although in the embodiment illustrated in FIGS. 6 and 7, it was explained that the troughs 207 extend from the receptacle 205, such troughs may be replaced with pipes or conduits which may also allow the pressurization of the mixed slurry discharged from the jet nozzles 209.

Also, in the embodiment illustrated in FIGS. 6 and 7, the stirring is effected by discharging the slurry out of the jet nozzles 209 mounted on the rotatable rake 204; however, it is possible as one of the modification of this invention to dispose an appropriate number of jet nozzles (not shown) in a stationary wall of the basin body 201 and to introduce the slurry into the basin through the nozzles on the wall in order to stir the mixed slurry held in the basin.

Figure 8:
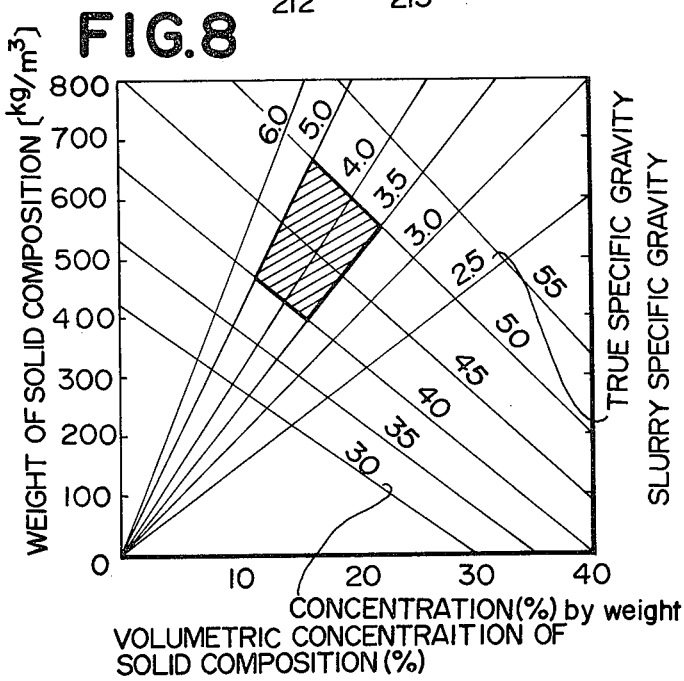
FIG. 8 is a graph similar to that shown in FIG. 2 but one for a self-liquid stirring system.

In the self-liquid stirring process, a test similar to that illustrated in FIG. 2 was conducted and the preferable range (shaded area) of operation with respect to the same factors as in those in FIG. 2 was obtained. The result of the test is illustrated in FIG. 8. It is apparent from this illustration that over 40% concentration (by weight) is preferable to achieve good stirring effect and maintain the uniformity.

Figure 9:
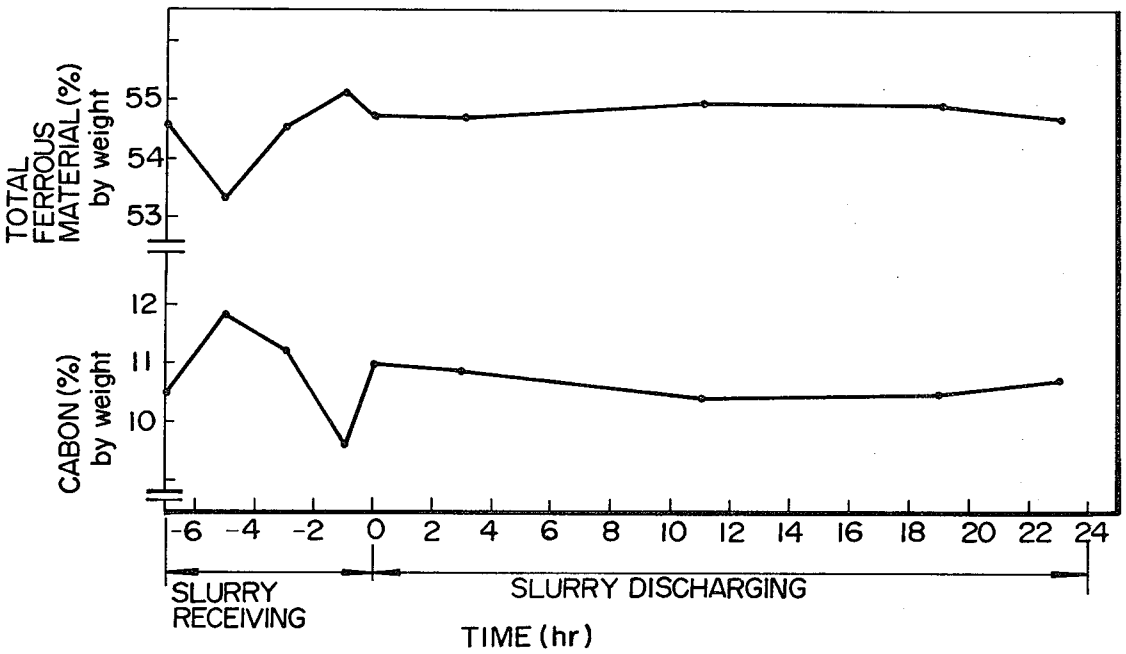
FIG. 9 shows test results indicating the uniformity of the mixed slurry in the basins of self-liquid stirring type.

Also, with respect to the uniformity of the mixed slurry according to the present invention, one of the test examples is illustrated in FIG. 9. This represents the result obtained by using two basins under "self-liquid stirring" process. Since the two basins were employed, the operation was conducted by alternating 48 hours batch system as explained with respect to FIG. 5. Therefore, at the end of receiving the slurry ("0" in the horizontal axis) the surface level of the slurry within the basin is at maximum and, at the end of the discharge ("24" in the horizontal axis), the level of the slurry is substantially at the bottom. The uniformity was examined by measuring the amount of total ferrous material and the amount of carbon. According to FIG. 9, it is apparent that the both were maintained within satisfactory ranges, (approx. within $\pm 1\%$) and especially it was excellent for the discharging period considering the variation of the surface level of the slurry in the bain.

The invention has been explained in detail referring to the preferred embodiments thereof; however, it will be apparent to those skilled in the art that several changes or modifications are available within the scope of the claims appended.

What is claimed is:

1. An apparatus for storing a slurry of dust from a steel mill for use in manufacturing pellets comprising:

(a) a basin having a bottom wall;

(b) an elongated shaft supported in said basin for rotation about a longitudinal, vertical axis, said shaft having an upper portion and a lower portion;

(c) rake means mounted on the lower portion of said shaft for rotation therewith in said basin;

(d) fluid injecting means for injecting fluid into said basin closely adjacent said bottom wall, said injecting means including a plurality of nozzles; and (e) drive means for rotating said shaft about said axis;

(f) a receptacle mounted on said upper portion for rotation therewith;

(g) feed means for feeding slurry to said receptacle during said rotation; and (h) a plurality of troughs attached to said receptacle and extending therefrom in a radially outward direction, each trough having an open end remote from said receptacle and communicating with said receptacle for discharging slurry fed by said feeding means from the open end thereof, the spacing of one of said open ends from said axis being different from the corrresponding spacing of another open end.

2. An apparatus for storing a slurry of dust from a steel mill for use in manufacturing pellets comprising:

(a) a basin;

(b) an elongated shaft supported in said basin for rotation about a longitudinal, vertical axis, said shaft having an upper portion and a lower portion;

(c) rake means mounted on the lower portion of said shaft for rotation therewith in said basin;

(d) fluid injecting means for injecting fluid into said basin, said injecting means including a plurality of nozzles disposed on said rake means;

(e) drive means for rotating said shaft about said axis;

(f) a receptacle mounted on said upper portion for rotation therewith;

(g) feed means for feeding slurry to said receptacle during said rotation, and (h) a plurality of conduits respectively connecting said receptacle to said nozzles for discharge of said slurry from said nozzles.

3. A method of storing a slurry of dust particles recovered from furnaces of a steel mill prior to manufacture of pellets from the recovered particles which comprises:

(a) mixing dust particles recovered from a blast furnace, dust particles recovered from a steel furnace, and water in a ratio to make the solids content of the resulting slurry more than 32% by weight; and (b) storing said slurry while injecting a mixture of dust particles and water into said slurry at a rate sufficient to keep said slurry substantially uniform.

* * * * *